US007485768B1

(12) United States Patent
Rice et al.

(10) Patent No.: US 7,485,768 B1
(45) Date of Patent: Feb. 3, 2009

(54) PROCESSES FOR MAKING HIGHER OCTANE MOTOR FUELS HAVING A LOW REID VAPOR PRESSURE FROM NAPHTHA BOILING RANGE FEEDSTOCKS

(75) Inventors: Lynn H. Rice, Arlington Heights, IL (US); Nelson A. Cusher, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 553 days.

(21) Appl. No.: 11/300,781

(22) Filed: Dec. 15, 2005

(51) Int. Cl.
*C07C 7/27* (2006.01)
*C10G 35/00* (2006.01)

(52) U.S. Cl. ..... 585/734; 585/737; 585/738; 208/133

(58) Field of Classification Search ..... 585/734, 585/737, 738; 208/133
See application file for complete search history.

(56) References Cited

U.S. PATENT DOCUMENTS 6,429,349 B1 8/2002 Grimes et al. ..... 585/719

OTHER PUBLICATIONS

I.A. Reddoch et al., *Seperation of Normal Paraffins from Isoparaffins*, Sep. 4-7, 1983; pp. 673-680.

*Primary Examiner*—Thuan Dinh Dang
(74) *Attorney, Agent, or Firm*—Maryann Maas

(57) ABSTRACT

Pentanes are separated from a naphtha boiling range feedstock to provide a gasoline stock having a high RON and low RVP. The isopentane is isomerized to make normal pentane and normal pentane is withdrawn as a feed, preferably for a steam cracker.

19 Claims, 4 Drawing Sheets

PROCESSES FOR MAKING HIGHER OCTANE MOTOR FUELS HAVING A LOW REID VAPOR PRESSURE FROM NAPHTHA BOILING RANGE FEEDSTOCKS

FIELD OF THE INVENTION

This invention pertains to processes for using naphtha boiling range feedstocks to provide a product suitable for use itself or for blending to make gasoline motor fuels having a low Reid Vapor Pressure (RVP), and more particularly to the recovery and use of pentanes from the feedstocks, especially for cracking feedstocks.

BACKGROUND OF THE INVENTION

Naphtha boiling range fractions have been used in the manufacture of stocks suitable for use or for blending with other petroleum and petrochemical stocks, to make gasoline motor fuels. A desirable component of a naphtha boiling range fraction for purposes of octane rating has been isopentane. Unfortunately, isopentane has a high vapor pressure (RVP of about 140 kPa) which can result in a gasoline product not meeting governmental standards. See, for instance, U.S. Pat. No. 6,429,349.

While isopentane can be removed from the naphtha boiling range feedstock, the demand for isopentane as a product or an intermediate in petrochemical processes is relatively limited. Moreover, isopentane is a less desirable as a feed to a cracking unit than is normal pentane. Cracking normal paraffins results in a higher product yield than does cracking isoparaffins. A paper entitled "Separation of Normal Paraffins from Isoparaffins" presented by I. A. Reddock, et al, at the Eleventh Australian Conference on Chemical Engineering, Brisbane, Sep. 4-7, 1983 discloses that the ethylene yield of a cracking unit can be increased if it is charged a $C_5$-$C_9$ stream of normal paraffins rather than a typical $C_5$-$C_9$ natural gasoline.

Consequently isopentane is often only of fuel value, e.g., to provide steam for other unit operations. However, often refineries and petrochemical facilities have sufficient waste gas that additional fuel values provided from isopentane removed from naphtha boiling range feedstocks are not needed.

Accordingly, processes are sought that can provide stocks desirable in gasoline applications in a manner that is efficient from capital cost and energy consumption standpoints while converting isopentane into a useful product.

SUMMARY OF THE INVENTION

By this invention, processes are provided that efficiently process naphtha boiling range feedstock to remove isopentane and convert it to useful product while providing a gasoline fraction having a low vapor pressure. The processes of this invention enable the conversion of isopentane to normal pentane to be effected by isomerization in an economically attractive manner even though most isomerization processes go toward an equilibrium rich in isopentane (e.g., the isomerate would contain less than about 40, and for many catalysts, only about 23 to 30 or less mole percent normal pentane). The processes of this invention enable this advantageous up-grading of feedstock by operation of distillation columns such that incremental normal pentane is provided at attractively low additional energy requirements.

In a broad aspect this invention pertains to a continuous process for upgrading a naphtha boiling range feedstock containing at least isopentane, normal pentane and hydrocarbons having 6 carbon atoms to provide a gasoline fraction stream having a reduced vapor pressure and a pentane fraction stream having reduced isopentane content comprising:

a. fractionating by distillation a stream which is at least a portion of the feedstock to provide
   (i) higher boiling fraction stream containing normal pentane and hydrocarbons having 6 carbon atoms and a reduce mole ratio of isopentane to normal pentane as compared to that of the feedstock, and
   (ii) lower boiling fraction steam containing isopentane and up to about 15, preferably between about 3 and 12, mole percent normal pentane based on total pentane in said fraction (herein referred to as the Pentane Purity Value);
b. subjecting lower boiling fraction stream to isomerization conditions to provide an isomerate stream containing between about 20 and 40, often between about 23 and 30, mole percent normal pentane based upon total pentanes and hydrocarbon by-products containing 4 and fewer carbon atoms;
c. recycling at least a portion of the isomerate stream to step (a);
d. removing hydrocarbons having up to 4 carbon atoms from said isomerate stream; and
e. fractionating by distillation hydrocarbons having 6 carbon atoms contained in the feed stream from normal pentane to provide;
   i. normal pentane-containing lower boiling fraction stream containing at least about 93, preferably at least about 95, say 95 to 99.9, mole percent of the normal pentane provided for the distillation, and
   ii. higher boiling fraction stream containing hydrocarbons having 6 carbon atoms and a RVP of up to about 50 kPa, wherein said lower boiling fraction stream of step (a) contains at least about 80, preferably at least about 85 or 90, mole percent of the isopentane contained in the aggregate of the feed stream and the recycle stream of step (c) (herein referred to as the Isopentane Recovery Value) and step (a) has a Refining Efficiency Index of at least 75.

The Refining Efficiency Index is as used herein is the Isopentane Recovery Value in mole percent less the Pentane Purity Value in mole percent. Thus, an Isopentane Recovery Value of 90 mole percent and a Pentane Purity Value of 10 mole percent provides a Refining Efficiency Index of 80.

The processes of this invention increase the portion of the total pentane that is normal pentane and hence, the normal pentane-containing fraction of step (e) is a more desirable feed for steam cracking. Although isopentane has value as a feed to a cracker, the relative value of isopentane will, in part, depend upon the sought products from the cracker.

Because step (e) is conducted such that at least 93 mole percent of the normal pentane is contained in the lower boiling fraction stream, the higher boiling, gasoline fraction stream will contain very little isopentane and little normal pentane. Hence, this stream often has an RON of at least 80 and an RVP of less than 30 kPa. Moreover, it can be subjected to isomerization under isomerization conditions to provide an isomerate having an increased mole fraction of branched and cyclic hydrocarbons. Due to the little pentane in this stream, the vapor pressure remains low as the isomerization can not generate undue amounts of isopentane. Preferably, the isomerate will have an RON of at least 87 and an RVP of less than 50 kPa. The distillation of step (e) may precede the distillation of step (a), in which case the portion of the feedstock passed to step (a) has a low concentration of hydrocarbons having 6 carbon atoms or it may follow the distillation of step (a), in which case the feedstock passed to step (a) either directly or subsequent to step (d).

In a preferred embodiment of this invention, step (d) is conducted prior to the recycle stream passing to the distillation of step (a). In a more preferred embodiment where the feedstock contains lights, at least a portion of the feed stream feedstock is fed to step (c).

DETAILED DESCRIPTION OF THE INVENTION

Figure 1:
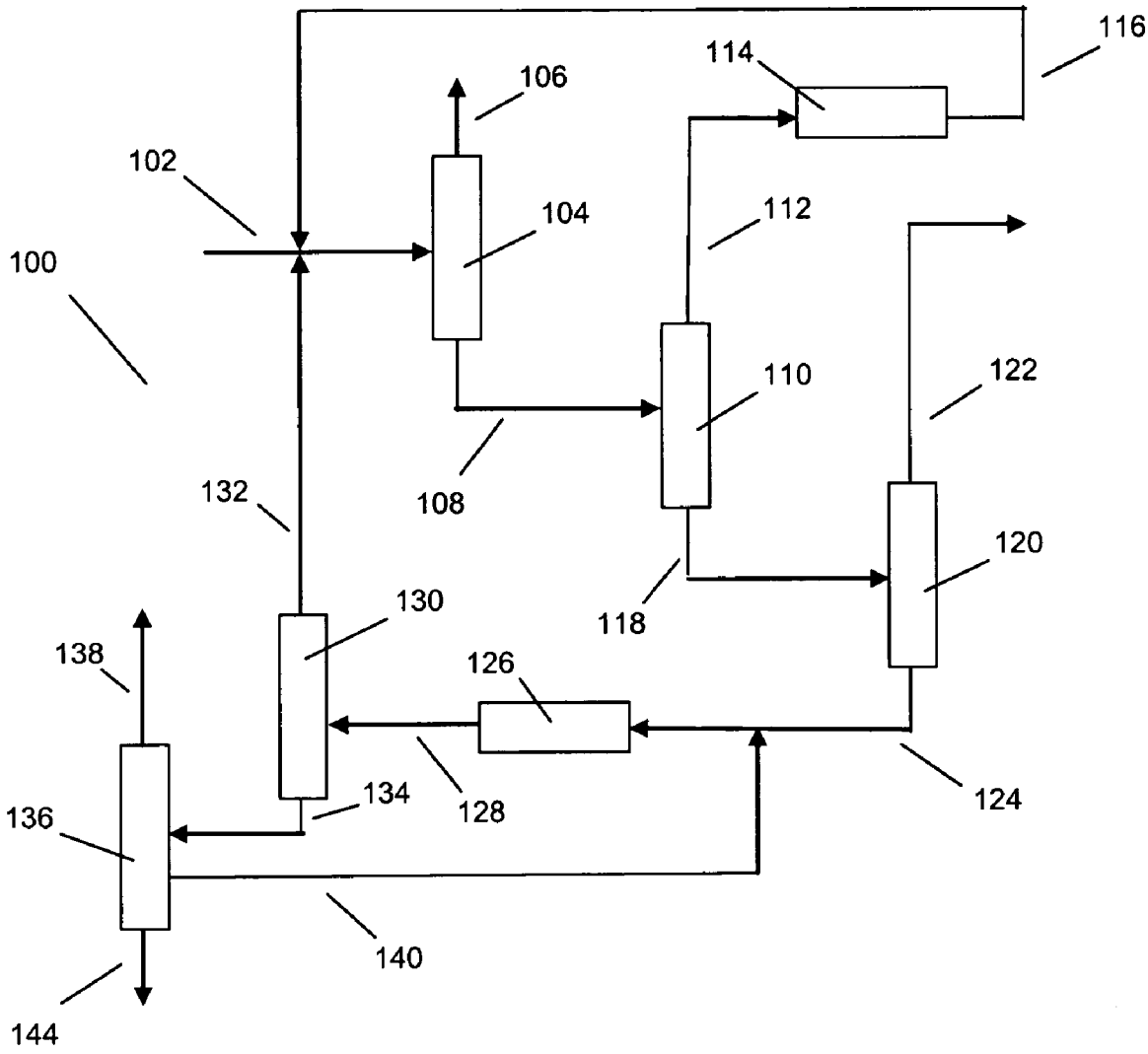
FIG. 1 is a schematic representation of an apparatus for practicing the processes of this invention wherein a naphtha boiling range feedstock is introduced into a stabilizer column for removing lights from a pentane isomerization effluent.

Any suitable paraffin-containing feedstock containing normal pentane, isopentane and hydrocarbon having 6 carbon atoms may be used in the processes of this invention. The feedstocks may contain higher and lower molecular weight hydrocarbons and other components. Often the normal pentane and isopentane comprise between 20 and 80 mole percent of the feedstock. These feedstock are referred to herein as naphtha boiling range feedstocks regardless of their origins.

Naphtha feedstocks are the most often used as the feedstocks to isomerization processes. Naphtha feedstocks comprise paraffins, naphthenes, and aromatics, and may comprise small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The feedstock essentially is encompassed by the range of a full-range naphtha, or within the range of 0° to 230° C. Usually the feedstock is light naphtha having an initial boiling point of about 10° to 65° C. and a final boiling point from about 75° to 110° C.; preferably, the final boiling point is less than about 95° C.

Naphtha feedstocks generally contain small amounts of sulfur compounds amounting to less than 10 mass parts per million (mppm) on an elemental basis. Preferably the naphtha feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from hydrocarbons by fractionation. This conversion preferably will employ a catalyst known to the art comprising an inorganic oxide support and metals selected from Groups VIB(IUPAC 6) and VIII(IUPAC 9-10) of the Periodic Table. Water can act to attenuate catalyst acidity by acting as a base, and sulfur can temporarily deactivate many types of catalysts. Feedstock hydrotreating as described hereinabove usually reduces water-generating oxygenates and deactivating sulfur compounds to suitable levels, and other means such as adsorption systems for the removal of sulfur and water from hydrocarbon streams generally are not required.

The principal components of the preferred feedstock are cyclic and acyclic paraffins having from 4 to 7 carbon atoms per molecule ($C_4$ to $C_7$), especially $C_5$ to $C_6$, and smaller amounts of aromatic and olefinic hydrocarbons also may be present. Usually, the concentration of $C_7$ and heavier components is less than about 20 mass-percent of the feedstock. Although there are no specific limits to the total content in the feedstock of cyclic hydrocarbons, the feedstock generally contains between about 2 and 40 mass-percent of cyclics comprising naphthenes and aromatics. The aromatics contained in the naphtha feedstock, although generally amounting to less than the alkanes and cycloalkanes, may comprise from 2 to 20 mass-percent and more usually 5 to 10 mass-percent of the total. Benzene usually comprises the principal aromatics constituent of the preferred feedstock, optionally along with smaller amounts of toluene and higher-boiling aromatics within the boiling ranges described above.

In general, the feedstocks used in the processes of this invention comprise non-linear and linear paraffins. For naphtha feedstocks, linear paraffins are typically present in amounts of at least about 30, say, 40 to 70, mass-percent. Non-linear paraffins include branched acyclic paraffins and substituted or unsubstituted cycloparaffins. Other components such as aromatics and olefinic compounds may also be present in the feedstocks as described above. In typical feedstocks used in accordance with this invention, the mole ratio of normal pentane to isopentane is within the range of about 0.5:1 to 3:1, often about 0.8:1 to 2:1.

As stated above, the preferred processes of this invention can use naphtha boiling range feedstocks that contain significant amounts of hydrocarbons containing up to 4 carbon atoms (lights). In general for these preferred aspects of the invention, the lights constitute less than about 30, more preferably less than about 25, and in some instances between about 5 and 20, mass-percent of the feedstock.

The point at which the feedstock is introduced into the apparatus is not critical in the broad processes of this invention. A number of options are afforded by this invention. One option is to fractionally distill the feedstock to provide a higher boiling stream rich in hydrocarbons having at least 6 carbon atoms and a lower boiling steam containing pentanes. The lower boiling stream can then be subjected to fractional distillation in the same or different distillation column to provide an isopentane-containing fraction and a normal pentane-containing fraction. This option is particularly attractive where the feedstock contains little lights. Another option is to introduce the feed into a lights distillation column that also processes a recycle stream from the isomerization of isopentane. This option is attractive where the feedstock contains lights and thus a single column can serve to remove lights from both streams.

The lights column may be of any suitable design and may be a flash fractionation, or more preferably a packed or trayed column. The number of theoretical distillation trays and the feed to reflux ratio can vary widely depending upon the composition of the feed and the sought fractions. Usually, the lights distillation serves only to remove lights from the feed and thus can operate at lower pressures, e.g., less than about 2000, preferably less than about 1500, kPa gauge. At these pressures, retention of isopentane in the bottoms stream is favored. Preferably less than about 10 percent of the isopentane in the feed is contained in the overhead from the lights column. In some instances, a portion of the butanes in the feed are contained in the bottoms, e.g., up to about 60 or 70, mass-percent of the butanes can be retained in the bottom from the lights column. However, sufficient butanes must be removed to enable steady state operation.

The bottoms from the lights distillation contains isopentane and normal pentane (and higher boiling hydrocarbons if not earlier removed) and is subjected to fractional distillation to separate isopentane from normal pentane. The column assembly may be of any suitable design and may be a flash fractionation, or more preferably a packed or trayed column. It is also contemplated in accordance with this invention that the distillation can provide other fractions including a fraction containing hydrocarbons having at least six carbon atoms where present in the feed to the distillation. For ease of reference, this distillation assembly will be referred to herein as a deisopentanizer.

The deisopentanizer provides a lower boiling fraction that is used as a feed to an isomerization reactor. This lower boiling fraction is an isopentane-rich, non-equilibrium fraction. The less normal pentane that is contained in this lower boiling fraction, the greater the percentage of the isopentane that can be converted to normal pentane in the isomerization. As the normal pentane equilibrium in the presence of many isomerization catalysts is in the range of about 20 to 40, most typically between about 23 to 30, mole percent based upon total normal pentane and isopentane, the processes of this invention provide that this lower boiling fraction has a Pentane Purity Value (i.e., contains) up to about 15, preferably less than about 12, and more preferably between 3 and 12, mole percent normal pentane based upon total pentanes. While lower Pentane Purity Values can be used in accordance with the broad aspects of the invention, the reboiler duty required for the separation is greater and may be less attractive in some situations.

The other parameter important to the operation of the deisopentanizer in accordance with this invention is the portion of the isopentane fed to the deisopentanizer that is recovered in the lower boiling fraction (Isopentane Recovery Value). As the Isopentane Recovery Value increases, the reboiler duty for the deisopentanizer increases. The Isopentane Recovery Value is at least about 80, preferably at least about 85 or 90, and frequently between about 90 and 98.

By this invention, incremental normal pentane can be produced with economically attractive reboiler energy consumption by the combination of the parameters of operation of the depentanizer, as discussed below, and the Pentane Purity Value and Isopentane Recovery Value of the deisopentanizer. At lower Isopentane Recovery Values, the Pentane Purity Values must be lower, i.e., less normal pentane can be contained in the lower boiling fraction of the deisopentanizer, than at higher Isopentane Recovery Values. Thus, in accordance with this invention, the Refining Efficiency Index for the deisopentanizer is at least 75, and is preferably is in the range of about 80 to 90, say, 80 to 88.

The higher boiling fraction from the deisopentanizer will contain normal pentane and some isopentane as determined by the Pentane Purity Value and Isopentane Recovery Value. The deisopentanizer may be separate or integrated with a subsequent depentanizer as discussed later. When integrated, the higher boiling fraction is that stream that internally passes into the section of the distillation assembly that effects the separation of pentanes from hydrocarbons having at least 6 carbon atoms. Alternatively, the depentanizer may precede the deisopentanizer. In that case, the lower boiling fraction is the normal pentane containing fraction stream of step (e).

The lower boiling fraction from the deisopentanizer is rich in isopentane. If desired, a portion of the fraction may be withdrawn as a source of isopentane with the remainder being directed to the isomerization. At least a portion of the isopentane-containing fraction from the deisopentanizer is passed to one or more isomerization zones. In the isomerization zone the isomerization feed is subjected to isomerization conditions including the presence of isomerization catalyst preferably in the presence of a limited but positive amount of hydrogen as described in U.S. Pat. No. 4,804,803 and U.S. Pat. No. 5,326,296, both herein incorporated by reference. The isomerization of paraffins is generally considered a reversible first order reaction. Thus, the isomerization reaction effluent will contain a greater concentration of non-linear paraffins and a lesser concentration of linear paraffins than does the isomerization feed. In preferred embodiments of this invention, the isomerization conditions are sufficient to achieve at least about 75, preferably at least about 90, say, 90 to 97, percent of equilibrium for $C_5$ paraffins present in the isomerization feed such that the isomerate contains at least about 23 mole percent normal pentane based upon total pentanes.

The isomerization catalyst is not critical to the broad aspects of the processes of this invention, and any suitable isomerization catalyst may find application. Suitable isomerization catalysts include acidic catalysts using chloride for maintaining the sought acidity, zeolitic catalysts and sulfated catalysts. The isomerization catalyst may be amorphous, e.g. based upon amorphous alumina, or zeolitic. A zeolitic catalyst would still normally contain an amorphous binder. The catalyst may comprise a sulfated zirconia and platinum as described in U.S. Pat. No. 5,036,035 and European patent application 0 666 109 A1 or a platinum group metal on chlorided alumina as described in U.S. Pat. No. 5,705,730 and U.S. Pat. No. 6,214,764. Another suitable catalyst is described in U.S. Pat. No. 5,922,639. U.S. Pat. No. 6,818,589 discloses a catalyst comprising a tungstated support of an oxide or hydroxide of a Group IVB (IUPAC 4) metal, preferably zirconium oxide or hydroxide, at least a first component which is a lanthanide element and/or yttrium component, and at least a second component being a platinum-group metal component. These documents are incorporated herein for their teaching as to catalyst compositions, isomerization operating conditions and techniques.

Contacting within the isomerization zones may be effected using the catalyst in a fixed-bed system, a moving-bed system, a fluidized-bed system, or in a batch-type operation. A fixed-bed system is preferred. The reactants may be contacted with the bed of catalyst particles in upward, downward, or radial-flow fashion. The reactants may be in the liquid phase, a mixed liquid-vapor phase, or a vapor phase when contacted with the catalyst particles, with excellent results being obtained by application of the present invention to a primarily liquid-phase operation. The isomerization zone may be in a single reactor or in two or more separate reactors with suitable means therebetween to insure that the desired isomerization temperature is maintained at the entrance to each zone. Two or more reactors in sequence are preferred to enable improved isomerization through control of individual reactor temperatures and for partial catalyst replacement without a process shutdown.

Isomerization conditions in the isomerization zone include reactor temperatures usually ranging from about 40° to 250° C. Lower reaction temperatures are generally preferred in order to favor equilibrium mixtures having the highest concentration of high-octane highly branched alkanes and to minimize cracking of the feed to lighter hydrocarbons. Temperatures in the range of from about 100° to about 200° C. are preferred in the present invention. Reactor operating pressures generally range from about 100 kPa to 10 MPa absolute, preferably between about 0.5 and 4 MPa absolute. Liquid hourly space velocities range from about 0.2 to about 25 volumes of isomerizable hydrocarbon feed per hour per volume of catalyst, with a range of about 0.5 to 15 $hr^{-1}$ being preferred.

Hydrogen is admixed with or remains with the isomerization feed to the isomerization zone to provide a mole ratio of hydrogen to hydrocarbon feed of from about 0.01 to 20, preferably from about 0.05 to 5. The hydrogen may be supplied totally from outside the process or supplemented by hydrogen recycled to the feed after separation from isomerization reactor effluent. Light hydrocarbons and small amounts of inerts such as nitrogen and argon may be present in the hydrogen. Water should be removed from hydrogen supplied from outside the process, preferably by an adsorption system as is known in the art. In a preferred embodiment the hydrogen to hydrocarbon mol ratio in the reactor effluent is equal to or less than 0.05, generally obviating the need to recycle hydrogen from the reactor effluent to the feed.

Especially where a chlorided catalyst is used for isomerization, the isomerization reaction effluent is contacted with a sorbent to remove any chloride components such as disclosed in U.S. Pat. No. 5,705,730. The isomerization reaction effluent is passed as feed to the lights column.

In the processes of this invention, normal pentane is separated from a higher boiling fraction containing hydrocarbons having 6 carbon atoms. The higher boiling fraction is used as a gasoline stock, either directly or after further processing. The point in the process where this gasoline fraction is taken can vary. For example, a normal pentane-containing fraction may be taken as a side stream from the deisopentanizer with a bottoms stream containing the $C_6$ and higher hydrocarbons (i.e., the deisopentanizer and depentanizer are integrated). Thus, the fractional distillation of step (a) is combined with the fractional distillation of step (e) and provides as said higher boiling fraction stream separate streams including the normal pentane-containing fraction stream of step (e) and the higher boiling fraction of step (e). Alternatively, a separate distillation column assembly may be used to separate normal pentane from hydrocarbon containing 6 carbon atoms. Where a separate distillation column assembly is used, it is referred to herein as a depentanizer. The depentanizer may precede or follow the deisopentanizer. The depentanizer assembly may be of any suitable design and may be a flash fractionation, or more preferably a packed or trayed column. A particularly beneficial design for a distillation assembly effecting both isopentane removal and normal pentane removal from a $C_6$ and higher hydrocarbon fraction is a dividing wall column. See, for instance, the article appearing at page 14 of a *Supplement to The Chemical Engineer*, Aug. 27, 1992, and U.S. Pat. No. 4,230,533.

The normal pentane-containing fraction from the depentanizer, or deisopentanizer as the case may be, is useful as feedstock for other chemical operations. Steam cracking is a particularly attractive use for the normal pentane due to the higher efficiency of olefin production achievable with the normal paraffin.

It is generally preferred that the normal pentane fraction contain relatively little of the $C_6$ and higher hydrocarbons as they are useful in the gasoline stock with the higher octane and low RVP. Typically, the normal pentane-containing fraction contains less than about 15, say between about 0.01 and 10, and preferably between about 0.05 and 7, mass-percent $C_6$ and higher hydrocarbons. In comparison to the deisopentanizer, the reboiler duty of the depentanizer is significantly less and does not materially change with increasing purity of the normal pentane fraction or with increasing recovery of pentane.

In the processes of this invention, the depentanizer (or depentanizer section of an integrated deisopentanizer) is operated such that the normal pentane-containing fraction contains at least about 93, preferably at least about 95, say 95 to 99.9, mole percent of the normal pentane provided for the distillation. By operating the depentanizer to recover such a high portion of the normal pentane, the aggregate reboiler duty for the deisopentanizer and depentanizer for generating incremental normal pentane via the isomerization, is attractively low. Moreover, not only will only a small amount of pentanes be contained in the gasoline stock, higher boiling fraction, but also that residual amount of pentanes will be essentially free of isopentane. Even if the gasoline stock is subjected to isomerization, the relative amount of normal pentane present can be sufficiently low that the RVP of the isomerized stock is acceptable.

The relative value of normal pentane to isopentane as a feedstock will vary depending upon the use of the normal pentane-containing fraction. For steam cracking, yields of ethylene and propylene from isopentane are about 70 percent of those from normal pentane. Additionally, the presence of isopentane may adversely affect the process such as my more readily coking or generating undesirable by-products or undesirable amounts of by-products. From an economic standpoint, the value of isopentane will be affected by whether it can be used for fuel. The artisan, by this invention, now has the ability to operate the deisopentanizer and depentanizer to optimize the conversion of isopentane to normal pentane, i.e., produce incremental normal pentane, for a given use of the normal pentane-containing fraction while still providing a gasoline stock having a desirable RVP. This optimization reflects the incremental reboiler duty required to make the incremental normal pentane. Advantageously, the incremental reboiler duty per incremental gram-mole of normal pentane can be less than about 1500, preferably less than about 1000, and most preferably less than about 750, kilocalories per gram-mole, with normal pentane being valued at 33 percent higher than isopentane. The incremental reboiler duty is the amount of the difference between the aggregate reboiler duty for the deisopentanizer and the depentanizer less that heat duty required to fractionally distill in the depentanizer the same feedstock and volume (excluding lights) to provide the same normal pentane recovery and pentane purity (amount of hydrocarbons of 6 and more carbon atoms in the normal pentane-containing, lower boiling fraction). The incremental gram-moles of normal pentane are the amount of the difference between the gram moles of normal pentane and 75 percent of the gram moles of isopentane in the normal pentane-containing, lower boiling fraction and the gram moles of normal pentane and 75 percent of the gram moles of isopentane in the feed stream.

The $C_6$ and higher hydrocarbon fraction can, if desired, be subjected to isomerization conditions to convert linear to branched hydrocarbons and thus improve the octane rating of the fraction. In the isomerization zone the isomerization feed is subjected to isomerization conditions including the presence of isomerization catalyst preferably in the presence of a limited but positive amount of hydrogen as described in U.S. Pat. No. 4,804,803 and U.S. Pat. No. 5,326,296, both herein incorporated by reference. The isomerization of paraffins is generally considered a reversible first order reaction. Thus, the isomerization reaction effluent will contain a greater concentration of non-linear paraffins and a lesser concentration of linear paraffins than does the isomerization feed. In preferred embodiments of this invention, the isomerization conditions are sufficient to isomerize at least about 20, preferably, between 30 and 60, mass-percent of the linears in the isomerization feed. In general, the isomerization conditions achieve at least about 70, preferably at least about 75, say, 75 to 97, percent of equilibrium for $C_6$ paraffins present in the isomerization feed.

The isomerization catalyst is not critical to the broad aspects of the processes of this invention, and any suitable isomerization catalyst may find application. Suitable isomerization catalysts include acidic catalysts using chloride for maintaining the sought acidity, zeolitic catalysts and sulfated catalysts. The isomerization catalyst may be amorphous, e.g. based upon amorphous alumina, or zeolitic. A zeolitic catalyst would still normally contain an amorphous binder. The catalyst may comprise a sulfated zirconia and platinum as described in U.S. Pat. No. 5,036,035 and European patent application 0 666 109 A1 or a platinum group metal on chlorided alumina as described in U.S. Pat. No. 5,705,730 and U.S. Pat. No. 6,214,764. Another suitable catalyst is described in U.S. Pat. No. 5,922,639. U.S. Pat. No. 6,818,589 discloses a catalyst comprising a tungstated support of an oxide or hydroxide of a Group IVB (IUPAC 4) metal, preferably zirconium oxide or hydroxide, at least a first component which is a lanthanide element and/or yttrium component, and at least a second component being a platinum-group metal component. These documents are incorporated herein for their teaching as to catalyst compositions, isomerization operating conditions and techniques.

Contacting within the isomerization zones may be effected using the catalyst in a fixed-bed system, a moving-bed system, a fluidized-bed system, or in a batch-type operation. A fixed-bed system is preferred. The reactants may be contacted with the bed of catalyst particles in upward, downward, or radial-flow fashion. The reactants may be in the liquid phase, a mixed liquid-vapor phase, or a vapor phase when contacted with the catalyst particles, with excellent results being obtained by application of the present invention to a primarily liquid-phase operation. The isomerization zone may be in a single reactor or in two or more separate reactors with suitable means therebetween to insure that the desired isomerization temperature is maintained at the entrance to each zone. Two or more reactors in sequence are preferred to enable improved isomerization through control of individual reactor temperatures and for partial catalyst replacement without a process shutdown.

Isomerization conditions in the isomerization zone include reactor temperatures usually ranging from about 40° to 250° C. Lower reaction temperatures are generally preferred in order to favor equilibrium mixtures having the highest concentration of high-octane highly branched alkanes and to minimize cracking of the feed to lighter hydrocarbons. Temperatures in the range of from about 100° to about 200° C. are preferred in the present invention. Reactor operating pressures generally range from about 100 kPa to 10 MPa absolute, preferably between about 0.5 and 4 MPa absolute. Liquid hourly space velocities range from about 0.2 to about 25 volumes of isomerizable hydrocarbon feed per hour per volume of catalyst, with a range of about 0.5 to 15 $hr^{-1}$ being preferred.

Hydrogen is admixed with or remains with the isomerization feed to the isomerization zone to provide a mole ratio of hydrogen to hydrocarbon feed of from about 0.01 to 20, preferably from about 0.05 to 5. The hydrogen may be supplied totally from outside the process or supplemented by hydrogen recycled to the feed after separation from isomerization reactor effluent. Light hydrocarbons and small amounts of inerts such as nitrogen and argon may be present in the hydrogen. Water should be removed from hydrogen supplied from outside the process, preferably by an adsorption system as is known in the art. In a preferred embodiment the hydrogen to hydrocarbon mol ratio in the reactor effluent is equal to or less than 0.05, generally obviating the need to recycle hydrogen from the reactor effluent to the feed.

Especially where a chlorided catalyst is used for isomerization, the isomerization reaction effluent is contacted with a sorbent to remove any chloride components such as disclosed in U.S. Pat. No. 5,705,730.

Preferably the isomerization reactor effluent is subjected to a lights distillation to remove methane, ethane and any other lower boiling materials coproduced during the isomerization. If desired, this distillation may be conducted such as to only remove the $C_3$ and lighter hydrocarbons. Alternatively, if butanes or pentanes are contained in the isomerization reactor effluent, the distillation may be conducted to provide a lower boiling fraction containing the butanes and, if present, pentanes as well as the $C_3$ and lighter hydrocarbons and a higher boiling fraction containing $C_6$ and higher hydrocarbons. The lower boiling stream, for instance, may be passed to the lights distillation column for separation of the butanes and lower boiling components from the pentanes. Any $C_6$ and higher hydrocarbons contained in the lower boiling fraction would thus be recovered and recycled.

The higher boiling fraction may be used as the stock for making gasoline. Thus, the isomerization of the $C_6$ and higher hydrocarbons would be a once through isomerization. In such instances, the RON (Research Octane Number, ASTM D2699-04a, in effect on Oct. 1, 2005) of the stock is frequently in the range of about 80 to 87. Advantageously, the stock does not suffer from an RON depression due to the undue presence of normal pentane. The RVP (ASTM D323-99a, in effect Oct. 1, 2005) is often less than about 50 kPa, and sometimes is less than about 30 kPa.

If higher octane rating stock is sought, the isomerization may be operated with a recycle of linear $C_6$ hydrocarbons. In this embodiment, branched and cyclic hydrocarbons are separated as a product fraction from a normal hydrocarbon-containing fraction. The normal hydrocarbon-containing fraction is recycled to the isomerization reaction. The separation may be effected by any suitable means. Separation techniques that have received widespread use are distillation (herein referred to as a deisohexanizer) and selective sorption (see, for instance, U.S. Pat. No. 4,717,784 and U.S. Pat. No. 4,804,802, herein incorporated by reference in their entireties). One of the disadvantages associated with the use of a deisohexanizer has been that normal pentane is contained in the lower boiling, branched and cyclic $C_6$ hydrocarbon-containing fraction. As the processes of this invention enable normal pentane to be removed prior to the isomerization of the $C_6$ and higher hydrocarbons, the fraction will have an enhanced octane rating.

The distillation assembly for the deisohexanizer may be of any suitable design such as one or more packed or trayed columns. The number of theoretical distillation trays and the feed to reflux ratio can vary widely depending upon the composition of the feed and the sought fractions. Usually, the deisohexanizer is operated to provide as a lower boiling fraction, the stock for making gasoline, a side fraction containing normal hexane, and a bottoms fraction containing $C_7$ and higher hydrocarbons.

The stock in the embodiments of this invention wherein the normal hexane is recycled to the isomerization reaction, regardless of the separation technique used, often has a RON of at least about 85, preferably at least 87, and sometimes between about 88 and 92. The RVP is typically less than about 50, preferably less than about 30, kPa.

DESCRIPTION OF THE DRAWINGS

With reference to FIG. 1, a system generally designated by 100 in accordance with this invention is depicted for producing a gasoline product from a naphtha boiling range feed. The naphtha boiling range feed is derived from a petroleum feedstock fractionation and contains lights as well as C5 and C6 hydrocarbons. The feedstock is passed via line 102 to lights distillation column 104. A lights-containing overhead is withdrawn from lights distillation column 104 via line 106 and will contain butanes and lower molecular weight hydrocarbons. If desired, butanes may be recovered from the lights-containing overhead, but usually, the overhead is used for fuel value.

A bottoms stream is withdrawn from lights distillation column 104 via line 108 and is passed to deisopentanizer distillation column 110. Deisopentanizer distillation column 110 is operated to provide an isopentane-containing overhead and a bottoms stream containing a reduced amount of isopentane. The relative separation between normal pentane and isopentane can vary over a wide range while still obtaining the benefits of the invention. The overhead from deisopentanizer distillation column 110 is passed via line 112 to isomerization reactor 114 where isopentane is isomerized to normal pentane. The isomerization is equilibrium limited. Thus, the presence of normal pentane in the overhead from deisopentanizer distillation column 110 will have the effect of reducing the amount of isopentane converted in each pass. On the other hand, achieving a greater degree of separation between isopentane and normal pentane will require greater energy consumption in the deisopentanizer distillation column to provide for a higher reflux ratio and a greater number of theoretical distillation trays.

An isomerate product containing a reduced fraction of isopentane is withdrawn from isomerization reactor 114 and directed by line 116 to the feed to lights distillation column 104. If, for example, a chlorided catalyst is used in isomerization reactor 114, unit operations may be additionally provided to remove chlorides from the isomerate product. Typically, the isomerization is conducted in the presence of hydrogen. Not shown is a fractionation for the recovery and recycle of hydrogen. As the isomerizate product is passed to lights distillation column 104, the column also serves to remove the lighter by-products generated during the isomerization.

Returning to deisopentanizer distillation column 110, a bottoms stream is withdrawn via line 118 and passed to depentanizer distillation column 120. A stream enriched in normal pentane is obtained as overhead and is directed via line 122 for further processing. Preferably, the normal pentane-containing overhead is used as a feed to a cracker to produce ethylene and propylene. Any isopentane contained in the bottoms stream from deisopentanizer distillation column 110 will be contained in the overhead of depentanizer distillation column 120. Hence, the operator has flexibility in the design and operation of deisopentanizer distillation column 110 as to the portion of the isopentane in the feed that is recovered in the overhead. One of the advantages that can be obtained where the overhead from the depentanizer distillation column 120 is that the feed is relatively free from branched hydrocarbons and thus an enhance efficiency of cracking can be obtained as well as a reduction in adverse reactions such as coking.

The bottoms stream from depentanizer distillation column 120 is relatively free from pentanes and is passed via line 124 to naphtha isomerization reactor 126. A naphtha isomerate product is withdrawn via line 128 and passed to naphtha isomerate lights distillation column 130. Not shown are unit operations to recover and recycle hydrogen to naphtha isomerization reactor 126 and removal of chlorides if a chlorided isomerization catalyst is used.

Naphtha isomerate distillation column 130 provides an overhead that is withdrawn via line 132. As shown, the overhead is passed to lights column 104 for an embodiment of the invention where the feed to naphtha isomerization reactor 126 contains pentanes. Alternatively, the overhead may be combined with the lights in line 106 or otherwise used or disposed. The bottoms from column 130 is passed via line 134 to deisohexanizer distillation column 136. An overhead containing isohexane is obtained as a product in line 138. As the overhead is substantially devoid of normal pentane, the product can have a relatively high octane rating, e.g., 88 RON or higher. Moreover, the overhead will be devoid of isopentane and thus may have an advantageous high vapor pressure. It can be used per se as motor fuel or may be blended with other components such as from a reformer. A normal hexane-containing side stream is recovered from deisohexanizer distillation column 136 and is recycled to naphtha isomerization reactor via line 140. Heavies, such as normal heptane are removed as a bottoms stream via line 144.

Figure 2:
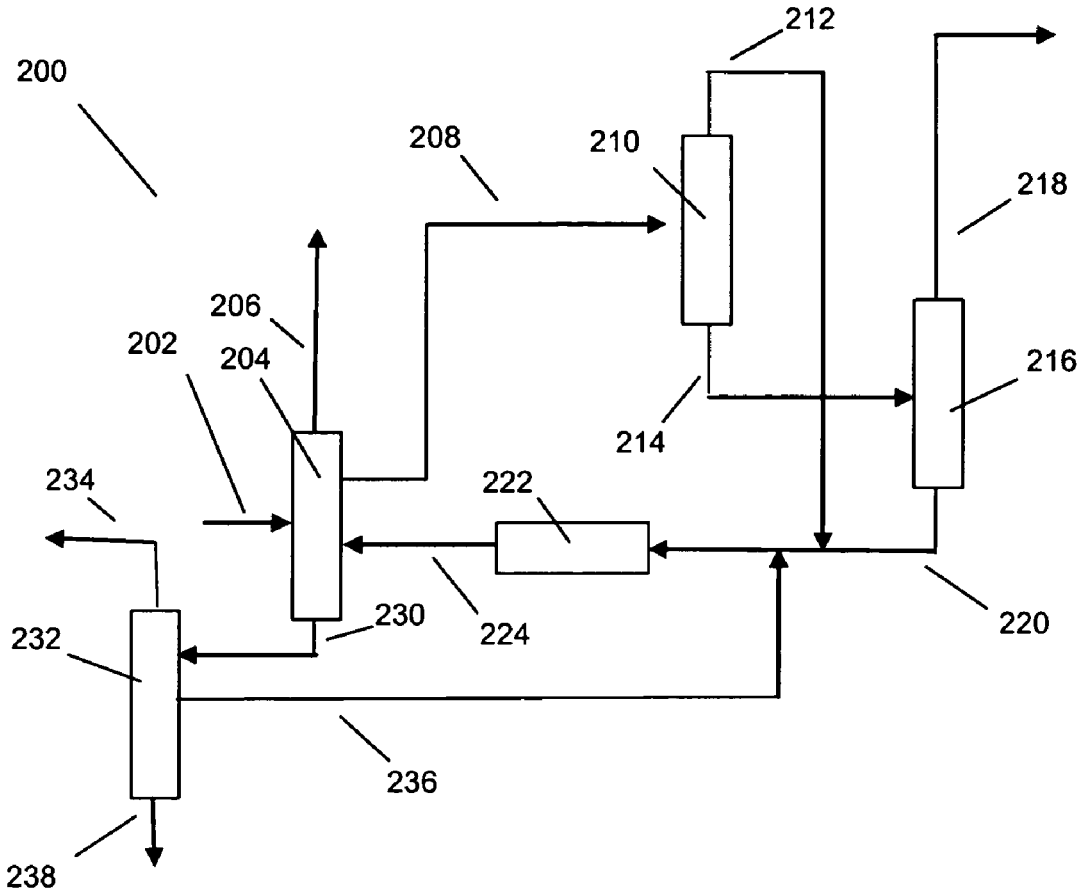
FIG. 2 is a schematic representation of another apparatus for practicing the processes of this invention.

In the process schematic depicted generally by 200 in FIG. 2, the naphtha isomerization reactor is fed both isopentane for isomerization to normal pentane and normal hexane for isomerization to isohexanes. A naphtha boiling range feedstock containing lights as well as C5 and C6 hydrocarbons is passed via line 202 to lights distillation column 204. A lights-containing overhead is withdrawn from lights distillation column 204 via line 206 and will contain butanes and lower molecular weight hydrocarbons. If desired, butanes may be recovered from the lights-containing overhead, but usually, the overhead is used for fuel value.

A pentane-containing sidestream is withdrawn from lights distillation column 204 via line 208 and is passed to deisopentanizer distillation column 210. Deisopentanizer distillation column 210 is operated to provide an isopentane-containing overhead and a bottoms stream containing a reduced amount of isopentane. The overhead from deisopentanizer distillation column 210 is passed via line 212 to isomerization reactor 222 which is discussed later. A bottoms stream from deisopentanizer distillation column 210 is withdrawn via line 214 and passed to depentanizer distillation column 216. A stream enriched in normal pentane is obtained as overhead and is directed via line 218 for further processing. Preferably, the normal pentane-containing overhead is used as a feed to a cracker to produce ethylene and propylene. The bottoms stream from depentanizer distillation column 216 is passed via line 220 to naphtha isomerization reactor 222. A naphtha isomerate product is withdrawn via line 224 and passed to lights distillation column 204. Not shown are unit operations to recover and recycle hydrogen to naphtha isomerization reactor 222 and removal of chlorides if a chlorided isomerization catalyst is used.

The bottoms from column 204 is passed via line 230 to deisohexanizer distillation column 232. An overhead containing isohexane is obtained as a product in line 234. A normal hexane-containing side stream is recovered from deisohexanizer distillation column 232 and is recycled to naphtha isomerization reactor via line 236. Heavies are removed as a bottoms stream via line 238.

Figure 3:
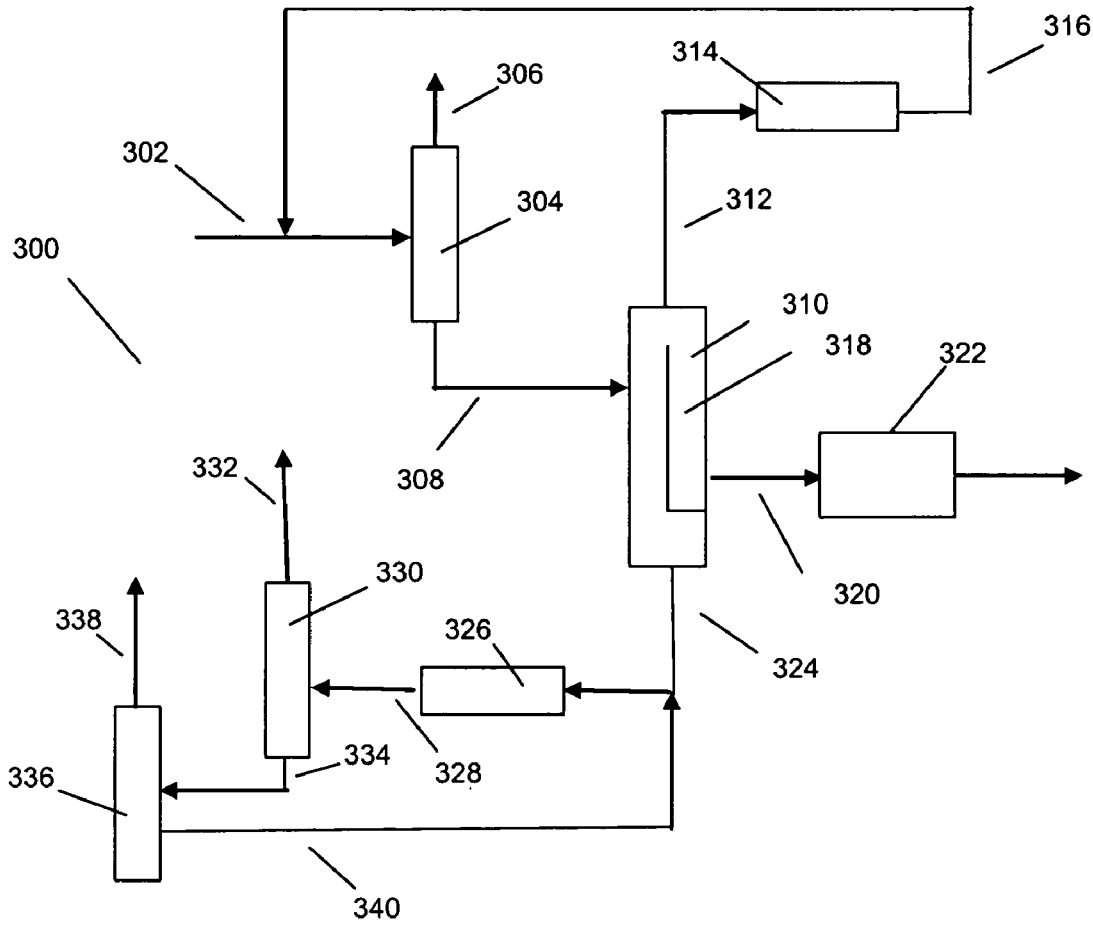
FIG. 3 is a schematic representation of another apparatus for practicing the processes of this invention in which a dividing wall distillation column is used to separate isopentane and normal pentane and to provide a fraction containing hydrocarbon of at least 6 carbon atoms.

In the process of this invention schematically depicted in FIG. 3 and generally designated as 300, a dividing wall column is used for separation of isopentane and normal pentane and the separation of $C_6$ and higher hydrocarbons. A naphtha boiling range feedstock containing lights as well as C5 and C6 hydrocarbons is passed via line 302 to lights distillation column 304. A lights-containing overhead is withdrawn from lights distillation column 304 via line 306 and will contain butanes and lower molecular weight hydrocarbons. If desired, butanes may be recovered from the lights-containing overhead, but usually, the overhead is used for fuel value.

A bottoms stream from lights distillation column 304 is passed via line 308 to dividing wall column 310. An overhead containing isopentane is obtained and passed via line 312 to isomerization reactor 314. The isomerate product is then directed by line 316 to lights column 304. Not shown are unit operations to recover and recycle hydrogen to isomerization reactor 314 and removal of chlorides if a chlorided isomerization catalyst is used.

Dividing wall column 310 is provided with a substantially impermeable baffle so as to provide two zones in the distillation column, a higher recovery zone and a normal pentane recovery zone. From the normal pentane recovery zone is withdrawn via line 320 a normal pentane-containing stream which is fed to cracker 322 to make ethylene, propylene and other olefins. The bottoms stream from dividing wall column 310 is passed via line 324 to naphtha isomerization reactor 326. A naphtha isomerate product is withdrawn via line 328 and passed to lights distillation column 330. Not shown are unit operations to recover and recycle hydrogen to naphtha isomerization reactor 326 and removal of chlorides if a chlorided isomerization catalyst is used.

The bottoms from column 330 is passed via line 334 to selective sorption unit 336. A stream containing isohexane is obtained as a product in line 338. A normal hexane-containing stream is recovered recycled to naphtha isomerization reactor via line 324.

Figure 4:
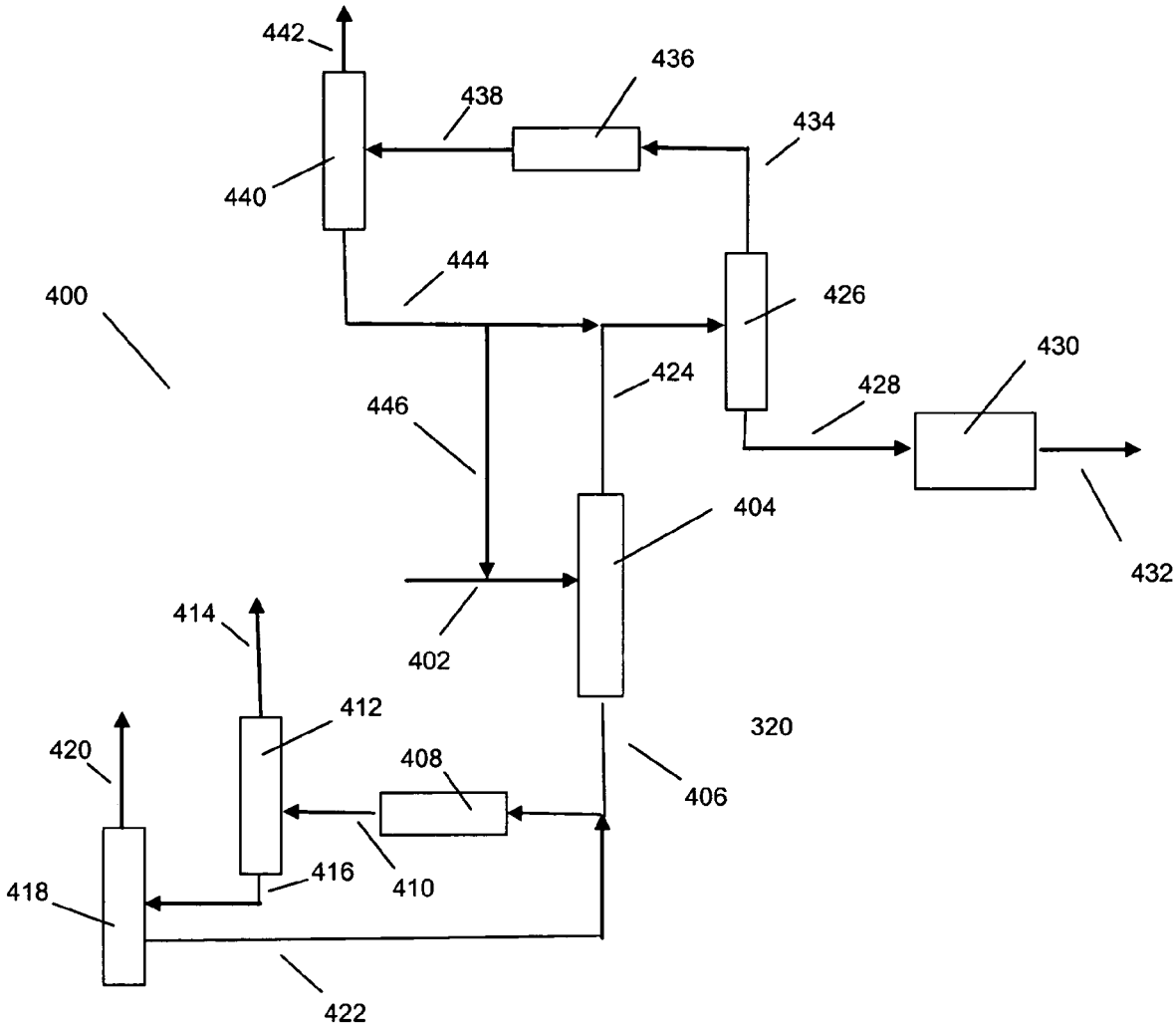
FIG. 4 is a schematic representation of another apparatus for practicing the processes of this invention in which the naphtha boiling range feedstock is first fractionated to remove pentanes with the fraction containing hydrocarbon of at least 6 carbon atoms being directed to a gasoline stock, and the pentane overhead is fractionated to provide an isopentane-containing fraction for isomerization and a bottoms stream for feeding to a cracker.

With reference to FIG. 4, a naphtha boiling range feedstock is provided via line 402 to system 400. Line 402 directs the feedstock to depentanizer column 404 which provides a bottoms stream depleted in pentanes. This bottoms stream is passed via line 406 to isomerization reactor 408 to provide an isomerate having an increased concentration of branched hydrocarbons. The isomerate is withdrawn via line 410 and passed to lights column 412 to remove lighter components which are discharged via line 414. The bottoms stream in lights column 412 is passed via line 416 to selective sorption unit 418 which provides a gasoline stock having high octane to line 420 and a normal paraffin fraction that is recycled to isomerization reactor 408 via line 422.

Returning now to depentanizer column 404, an overhead containing isopentane and normal pentane is passed via line 424 to deisopentanizer 426. The bottoms stream from deisopentanizer 426 is rich in normal pentane and is passed via line 428 to steam cracker 430 to produce lower olefin-containing product that is withdrawn via line 432.

The overhead from deisopentanizer 426 is rich in isopentane and is passed via line 434 to isomerization reactor 436 which provides an isomerate containing a greater fraction of normal pentane. The isomerate is directed to lights column 440 and lights are exhausted via line 442 and the bottoms stream is recycled via line 444 to deisopentanizer 426. The isomerization typically generates some hydrocarbons having 6 and more carbons, and these higher hydrocarbons can be removed with the bottoms stream from deisopentanizer 426. If desired, a purge can be withdrawn via line 446 to prevent the build up of these higher hydrocarbons. The purge may be exhausted or, as shown, recycled to depentanizer 404.

Computer simulations are conducted based upon a process using the system depicted in FIG. 1 except that the overhead in line 132 that is withdrawn from isomerate distillation column 130 is sent to battery limits. A summary of the results of the simulations are presented in Table 1. In all simulations, the feedstock comprises 4.7 mole percent $C_4$; 20.8 mole percent isopentane; 26.8 mole percent normal pentane and the balance $C_6$ and higher hydrocarbons. The incremental heat duty per incremental gram-mole of normal pentane is reported in terms of relative value of isopentane to normal pentane. This analysis reflects that isopentane does have some value. By way of example, at 33%, normal pentane would be 33% more valuable than isopentane, and a mixture containing 100 parts normal pentane and 40 parts isopentane would have the same value as 130 parts of normal pentane alone.

TABLE 1

| Simulation | Isopentane Recovery Value | Pentane Purity Value | n-pentane recovery in depentanizer, mole % | $C_6$ and highers in depentanizer overhead, mole % | Incremental heat duty per incremental g-mol of n-pentane, kcal % n-$C_5$ more valuable than i-$C_5$ 22 | 33 | 44 |
|---|---|---|---|---|---|---|---|
| A | 80 | 5 | 95 | 5 | 1128 | 865 | 723 |
| B | 90 | 5 | 95 | 5 | 1220 | 908 | 746 |
| C | 95 | 5 | 95 | 5 | 1316 | 963 | 785 |
| D | 90 | 10 | 95 | 5 | 1013 | 758 | 624 |
| E | 90 | 5 | 99 | 5 | 770 | 635 | 552 |
| F | 90 | 5 | 99 | 1 | 793 | 653 | 569 |
| G* | 80 | 5 | 80 | 5 | loss | loss | loss |
| H* | 90 | 5 | 90 | 5 | 5614 | 2146 | 1408 |
| I* | 80 | 10 | 99 | 5 | 3054 | 1584 | 1125 |
| J* | 90 | 10 | 90 | 10 | 6079 | 2259 | 1474 |

*Comparative

Similar computer simulations using the system of FIG. 4 indicate that the incremental reboiler heat duty per incremental gram-mole of n-pentane is less than that for the system of FIG. 1 for given recoveries and purities for the depentanizer and deisopentanizer columns. Often, the incremental reboiler heat duties can be reduced by at least 10, and more frequently, at least about 12, say 12 to 15, percent.

What is claimed is:

1. A continuous process for upgrading a naphtha boiling range feedstock containing at least isopentane, normal pentane and hydrocarbons having 6 carbon atoms to provide a gasoline fraction stream having a reduced vapor pressure and a pentane fraction stream having reduced isopentane content comprising:

a. fractionating by distillation a stream which is at least a portion of the feedstock to provide
   (i) higher boiling fraction stream containing normal pentane and hydrocarbon having 6 carbons atoms and a reduce mole ratio of isopentane to normal pentane as compared to that of the feedstock, and
   (ii) lower boiling fraction steam containing isopentane and up to about 15 mole percent normal pentane based on total pentane in said fraction;

b. subjecting lower boiling fraction stream to isomerization conditions to provide an isomerate stream containing between about 20 and 40 mole percent normal pentane based upon total pentanes and hydrocarbon by-products containing 4 and fewer carbon atoms;

c. recycling at least a portion of the isomerate stream to step (a);

d. removing hydrocarbons having up to 4 carbon atoms from said isomerate stream; and e. fractionating the higher boiling fraction stream by distillation hydrocarbons having 6 carbon atoms contained in the feed stream from normal pentane to provide;

i. normal pentane-containing lower boiling fraction stream containing at least about 93 mole percent of the normal pentane provided for the distillation, and ii. higher boiling fraction stream containing hydrocarbons having 6 carbon atoms and a RVP of up to about 50 kPa, wherein said lower boiling fraction stream of step (a) contains at least about 80 mole percent of the isopentane contained in the aggregate of the feed stream and the recycle stream of step (c) and step (a) has a Refining Efficiency Index of at least 75.

2. The process of claim 1 wherein at least a portion of the normal pentane-containing fraction of step (e) is passed as feed stream to a steam cracker.

3. The process of claim 1 wherein at least a portion of the higher boiling fraction stream of step (e) is subjected to isomerization under isomerization conditions to provide an isomerate having an increased mole fraction of branched and cyclic hydrocarbons.

4. The process of claim 1 wherein the fractional distillation of step (a) is combined with the fractional distillation of step (e) and provides as said higher boiling fraction stream separate streams including the normal pentane-containing fraction stream of step (e) and the higher boiling fraction of step (e).

5. The process of claim 4 wherein the higher boiling fraction stream of step (e) has an RON of at least 80 and an RVP of less than 30 kPa.

6. The process of claim 1 wherein the higher boiling fraction stream of step (e) has an RON of at least 80 and an RVP of less than 30 kPa.

7. The process of claim 6 wherein the higher boiling stream of step (e) is isomerized under isomerization conditions to provide an isomerate stream having a reduced concentration of normal hydrocarbons, and the isomerate stream is separated into a fraction containing branched and cyclic $C_6$ hydrocarbons and at least one fraction containing normal hexane and at least a portion of said fraction containing normal hexane is recycled for isomerization.

8. The process of claim 7 wherein the fraction containing branched and cyclic $C_6$ hydrocarbons has an RON of at least 87 and an RVP of less than 50 kPa.

9. The process of claim 1 wherein at least a portion of the feed stream feedstock is fed to step (c).

10. The process of claim 1 wherein the normal pentane-containing lower boiling fraction stream of step (e) contains at least about 95 mole percent of the normal pentane contained in the higher boiling fraction of step (a).

11. The process of claim 1 wherein the lower boiling fraction stream of step (a) contains at least about 90 mole percent of the isopentane contained in the aggregate of the feed stream and the recycle stream of step (c).

12. The process of claim 11 wherein the lower boiling fraction steam of step (a) contains between about 3 to 12 mole percent normal pentane based on total pentane in said fraction.

13. A continuous process for upgrading a naphtha boiling range feedstock containing at least isopentane, normal pentane and hydrocarbons having 6 carbon atoms to provide a gasoline fraction stream having a reduced vapor pressure and a pentane fraction stream having reduced isopentane content comprising:

a. fractionating by distillation said naphtha boiling range feedstock to provide:

i. pentane-containing lower boiling fraction stream containing at least about 93 mole percent of the normal pentane in said feedstock, and ii. higher boiling fraction stream containing hydrocarbons having 6 carbon atoms and a RVP of up to about 50 kPa;

b. fractionating by distillation at least a portion of the pentane-containing lower boiling fraction stream of step (a) to provide:

(i) higher boiling fraction stream containing normal pentane and a reduce mole ratio of isopentane to normal pentane as compared to that of the feedstock, and (ii) lower boiling fraction steam containing isopentane and up to about 15 mole percent normal pentane based on total pentane in said fraction c. subjecting lower boiling fraction stream to isomerization conditions to provide an isomerate stream containing between about 20 and 40 mole percent normal pentane based upon total pentanes and hydrocarbon by-products containing 4 and fewer carbon atoms;

d. recycling at least a portion of the isomerate stream to step (b); and e. removing hydrocarbons having up to 4 carbon atoms from said isomerate stream wherein said lower boiling fraction stream of step (a) contains at least about 80 mole percent of the isopentane contained in the aggregate of the feed stream and the recycle stream of step (c) and step (a) has a Refining Efficiency Index of at least 75.

14. The process of claim 13 wherein at least a portion of the normal pentane-containing fraction of step (b) is passed as feed stream to a steam cracker.

15. The process of claim 13 wherein at least a portion of the higher boiling fraction stream of step (a) is subjected to isomerization under isomerization conditions to provide an isomerate having an increased mole fraction of branched and cyclic hydrocarbons.

16. The process of claim 13 wherein the pentane-containing lower boiling fraction stream of step (a) contains at least about 95 mole percent of the normal pentane contained in the feedstock.

17. The process of claim 13 wherein the lower boiling fraction stream of step (b) contains at least about 90 mole percent of the isopentane contained in the aggregate of the feed stream and the recycle stream of step (d).

18. The process of claim 17 wherein the lower boiling fraction steam of step (b) contains between about 3 to 12 mole percent normal pentane based on total pentane in said fraction.

19. The process of claim 13 wherein the higher boiling fraction stream of step (a) has an RON of at least 80 and an RVP of less than 30 kPa.

* * * * *